US009874421B2

(12) United States Patent
Stockdill

(10) Patent No.: US 9,874,421 B2
(45) Date of Patent: Jan. 23, 2018

(54) RETICLE PIECE HAVING LEVEL INDICATING DEVICE

(71) Applicant: Lightforce USA, Inc., Orofino, ID (US)

(72) Inventor: Kevin Stockdill, Orofino, ID (US)

(73) Assignee: Lightforce USA, Inc., Orofino, ID (US)

( * ) Notice: Subject to any disclaimer, the term of this patent is extended or adjusted under 35 U.S.C. 154(b) by 161 days.

(21) Appl. No.: 15/053,358

(22) Filed: Feb. 25, 2016

(65) Prior Publication Data

US 2016/0169619 A1 Jun. 16, 2016

Related U.S. Application Data

(63) Continuation-in-part of application No. 14/039,260, filed on Sep. 27, 2013, now Pat. No. 9,285,187.

(60) Provisional application No. 61/708,731, filed on Oct. 2, 2012.

(51) Int. Cl.
*F41G 1/44* (2006.01)

(52) U.S. Cl.
CPC ..... *F41G 1/44* (2013.01)

(58) Field of Classification Search
CPC ..... G02B 27/32; F41G 1/12; F41G 1/44
USPC ..... 33/297, 298, 354
See application file for complete search history.

(56) References Cited

U.S. PATENT DOCUMENTS 1,955,746 A 4/1934 Inglis
2,094,623 A 10/1937 Stokey
2,420,253 A * 5/1947 Land ..... G02B 27/32 33/276
2,580,280 A 12/1951 Bullard
3,381,380 A * 5/1968 Thomas ..... F41G 1/12 33/297
3,556,666 A 1/1971 Lichtenstein
(Continued)

FOREIGN PATENT DOCUMENTS

DE 003401855 A1 7/1985
DK 1787924 U 4/1959
(Continued)

OTHER PUBLICATIONS

International Searching Authority, International Search Report and Written Opinion, International Application No. PCT/US13/63057, dated Jul. 11, 2014, 12 pp.
(Continued)

*Primary Examiner* — G. Bradley Bennett
(74) *Attorney, Agent, or Firm* — Wood Herron & Evans LLP

(57) ABSTRACT

An improved reticle piece for use in an optical sight, placed at either the first or second focal plane, and an associated method of manufacturing. The reticle piece includes a first portion having a front face, a second portion having a back face disposed opposite the front face, a housing, a reticle pattern on the second portion, and a moveable leveling indicator. The housing includes a spacing element that forms a cavity extending between the first and second portions, the cavity having a perimeter that defines a viewable area of the reticle piece. The moveable leveling indicator is within the cavity and capable of moving along at least a portion of the perimeter of the cavity, possibly moving along the entire perimeter of the cavity.

20 Claims, 11 Drawing Sheets

(56) References Cited

U.S. PATENT DOCUMENTS

| | | | | |
|---|---|---|---|---|
| 5,223,650 | A | 6/1993 | Finn | |
| 5,657,571 | A | 8/1997 | Peterson | |
| 5,920,995 | A | 7/1999 | Sammut | |
| 6,032,374 | A * | 3/2000 | Sammut | F41G 1/38 42/122 |
| 6,865,022 | B2 * | 3/2005 | Skinner | G02B 23/10 359/399 |
| 6,978,569 | B2 | 12/2005 | Williamson, IV et al. | |
| 7,296,358 | B1 | 11/2007 | Murphy et al. | |
| 7,530,193 | B2 | 5/2009 | Williamson, IV et al. | |
| 8,069,577 | B1 | 12/2011 | Willman et al. | |
| 8,286,383 | B2 | 10/2012 | Matthews | |
| 8,819,985 | B1 * | 9/2014 | McCoy | F41G 1/54 33/373 |
| 9,285,187 | B2 * | 3/2016 | Stockdill | F41G 1/44 |
| 2003/0177685 | A1 * | 9/2003 | Pinkley | F41G 1/44 42/135 |
| 2005/0229468 | A1 * | 10/2005 | Zaderey | F41G 1/38 42/122 |
| 2014/0319216 | A1 * | 10/2014 | Meinert | F41G 1/387 235/406 |

FOREIGN PATENT DOCUMENTS

| | | | |
|---|---|---|---|
| DK | 3834924 | A1 | 4/1990 |
| EP | 0497301 | A2 | 8/1992 |
| FR | 1331706 | A | 7/1963 |

OTHER PUBLICATIONS

Australian Patent Office, Search Report issued in Australian Patent Application No. 2013371616 dated Jul. 22, 2016, 3 pages.

European Patent Office, Search Report issued in European Patent Application No. 13869942.6 dated Jun. 14, 2016, 6 pages.

* cited by examiner

RETICLE PIECE HAVING LEVEL INDICATING DEVICE

CROSS-REFERENCE TO RELATED APPLICATIONS

This application is a continuation-in-part of U.S. application Ser. No. 14/039,260, filed Sep. 27, 2013 (pending) which claims the filing benefit of U.S. Provisional Application No. 61/708,731, filed Oct. 2, 2012 (expired), the contents of which are incorporated by reference herein in their entirety.

FIELD OF THE INVENTION

The present invention generally relates to sight devices, such as optical sights. More particularly, the invention relates to a reticle piece for an optical sight having a level indicating device.

BACKGROUND

Sight devices are commonly used with firearms to provide a shooter with an aiming point. Several types of sight devices are available. For example, iron sights typically include a first sight piece positioned near the muzzle end of a firearm and a second sight piece positioned nearer to the breach end. The first and second sight pieces are positioned appropriately with respect to one another to align the firearm with a target.

Optical sights are another type of sight device and include optical components, such as lenses, and an indication of an aiming point. Typically, this indication of an aiming point is in the form of a reticle, which can have many configurations, such as dots, crosshairs, and others. Telescopic sights are a type of optical sight and include lenses that magnify the image viewed through the telescopic sight.

A reticle is typically provided in an optical sight by positioning a reticle piece, sometimes referred to as reticle glass, at an appropriate position in the optical components of the optical sight. A reticle piece includes a reticle pattern and is typically positioned at a focal plane so that it provides an in-focus reticle, when viewed by a shooter. For example, telescopic sights typically include a front focal plane and a rear focal plane, and the reticle piece can be positioned at either of those focal planes. In addition to the embodiments described herein, a reticle pattern may be used in the first focal plane while the leveling indicator device (without a reticle pattern) is used in the second focal plane or vice versa.

A reticle is a graphic image superimposed over the view seen through an optical sight. A crosshair reticle is a common type of reticle and includes a vertical segment and a horizontal segment which intersect one another in a central region of the view seen through the optical sight. In general, the intersection of the vertical and horizontal segments provides the aiming point that a shooter aligns with a target.

For relatively close targets, the aiming point may coincide with the point that a bullet will impact. In addition, either or both of the vertical and horizontal segments can include additional markings relevant to factors relating to an appropriate aiming point. For example, a vertical segment may include graduated hashes or other marks that correspond with the amount that a bullet will drop (due to gravity) as it follows its trajectory to a distant target. For more distant targets, the aiming point provided by the intersection of the vertical and horizontal segments of the reticle may not coincide with a point of bullet impact unless the aiming point is adjusted to compensate for bullet drop. Generally, as the distance to a target increases, a shooter will have to account for the amount that a bullet will drop. The graduated hashes on the vertical segment of the reticle can assist a shooter in addressing this bullet drop.

If an optical sight is properly leveled with respect to the ground, the bullet drop will follow along the vertical segment of the reticle (assuming there is no cross-wind). If the optical sight is not properly leveled, however, such as if the firearm to which the optical sight is attached is held in a tilted orientation, then the bullet drop will not follow along the vertical segment of the reticle, and the graduated hashes on the vertical segment will not be useful to the shooter.

There is a need, therefore, for devices that provide an indication of whether an optical sight is properly leveled with respect to the ground. Various external devices have been used, but these require the shooter to move his eye away from the view through the optical sight in order to check or confirm the level of the firearm. The shooter must then return his view to the optical sight, which takes longer with the external device. Various electronic devices have been proposed which provide an internally viewed level indicator, but these require a power source and significantly increase the cost of the optical sight. Internal mechanical devices have to be trued to the reticle and are subject to becoming misaligned.

SUMMARY OF THE INVENTION

The present invention overcomes the foregoing problems and other shortcomings and drawbacks of known optical sights. While the present invention will be described in connection with certain embodiments, it will be understood that the present invention is not limited to these embodiments. To the contrary, this invention includes all alternatives, modifications, and equivalents as may be included within the spirit and scope of the present invention.

According to one embodiment of the present invention, a reticle piece for use in an optical sight includes a generally cylinder-shaped body having a front face and a back face opposed therefrom. The reticle piece includes a reticle pattern and a level indicating device positioned between the front face and the back face of the body. The level indicating device includes a moveable leveling indicator.

According to another embodiment of the present invention, an improved reticle piece for use in an optical sight that includes a first portion having a front face, a second portion having a back face disposed opposite the front face, a housing, a reticle pattern on the second portion, and a moveable leveling indicator. The housing includes a spacing element that forms a cavity extending between the first and second portions, the cavity having a perimeter that defines a viewable area of the reticle piece. The moveable leveling indicator is within the cavity and capable of moving along at least a portion of the perimeter of the cavity, possibly moving along the entire perimeter of the cavity.

The reticle piece may include a third portion disposed between the first and second portions, such that the cavity is formed between the first and third portions and the reticle pattern is on one of the second or third portions.

The spacing element may include front and back sealing elements and a projection therebetween, and/or front and back locking elements. The front locking element couples the first portion to the housing and the back locking element couples the second portion to the housing. The housing may include an illumination port configured to receive light from a light source allowing for the reticle pattern to be illuminated.

The moveable leveling indicator may include a microsphere trapped in fluid. The densities of the microsphere and the fluid are within about 10% of each other. Additionally, depending on the density of the leveling indicator material and fluid density, the leveling indicator or microsphere may, as desired, either sink to the bottom or float to the top of the contained fluid to provide an indication of level. Alternatively, the moveable leveling indicator includes a bubble trapped in fluid.

The fluid may vary according to the various embodiments. In one embodiment, the fluid includes about 70-90% of Ethyl Alcohol, about 0-10% of a solute of a surfactant, and about 9-29% of Propylene Carbonate, and preferably about 80% of Ethyl Alcohol, about 1% of a solute of a surfactant, and about 19% of Propylene Carbonate. In another embodiment, the fluid includes more than 90% of Ethyl Acetate and less than 10% of a solute of a surfactant, and preferably about 99% of Ethyl Acetate and about 1% of a solute of a surfactant. In still yet other embodiments, the fluid is 100% Ethyl Acetate or 100% Propylene Carbonate.

The reticle piece may further include indicia marking a position of the moveable leveling indicator when the reticle body is level. The indicia formed on the reticle piece may include gradation units of tilt.

According to another aspect of the present invention, a method of manufacturing a reticle piece for use in an optical sight is described. The method includes inserting the third portion into the housing adjacent the rear side of the projection, inserting the second portion into the housing adjacent the third portion, coupling the back locking element to the housing to secure the second and third portions, inserting the moveable leveling indicator into a cavity formed by the third portion and the spacing element, filling the cavity with a fluid, inserting the second portion adjacent the front side of the projection to enclose the cavity and coupling the front locking element to the housing to secure the first portion.

Additionally, the cavity may be overfilled with fluid to form a meniscus that prevents air from being introduced into the cavity when the second portion is subsequently inserted. A back sealing element may be inserted adjacent the back face of the projection prior to inserting the third portion into the housing, and a front sealing element may be inserted adjacent the front face of the projection prior to inserting the moveable leveling indicator.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention. Like parts are identified by like reference numerals throughout the various figures of the drawing, wherein.

DETAILED DESCRIPTION

Referring to the figures, reticle pieces are shown which are generally useful for providing a reticle in an optical sight for a firearm. The reticle pieces are configured to be included with the optical components of an optical sight so that a reticle pattern is superimposed over the view seen through the optical sight. For example, the reticle pieces can be used in telescopic sights, and can be placed in either the first or second focal plane of a telescopic sight, as appropriate or desired.

Figure 1:
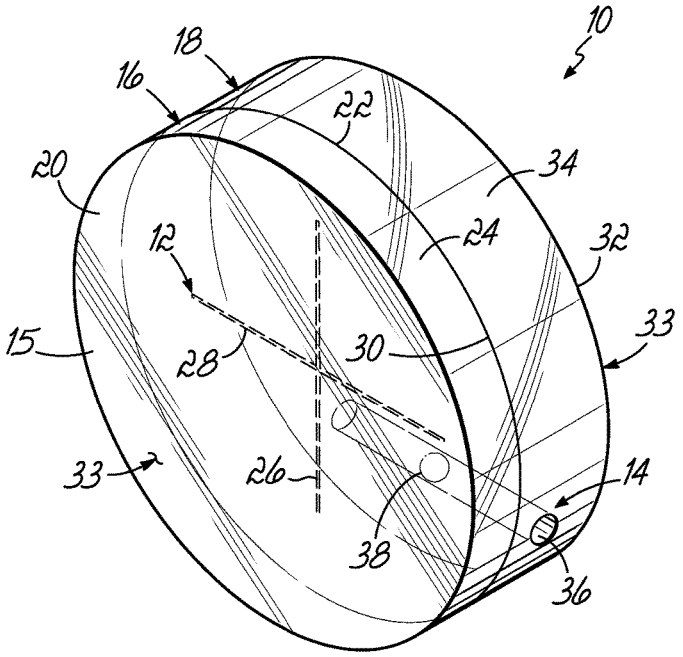
FIG. 1 is an isometric view of a reticle piece constructed according to the concepts of the present invention and including a level indicating device.
Figure 2:
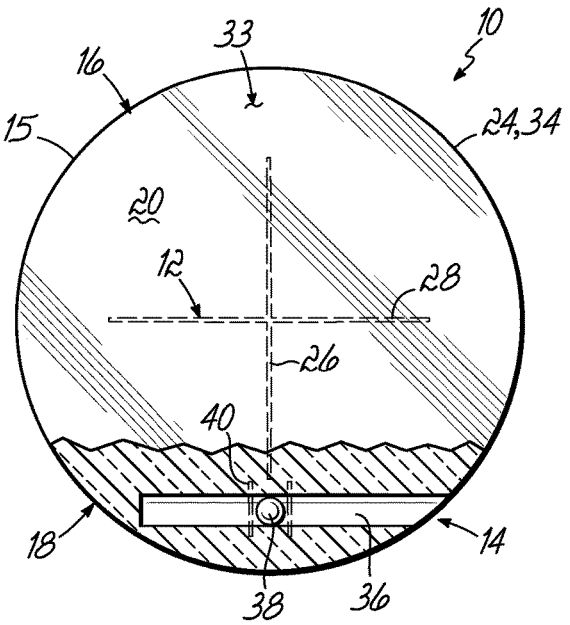
FIG. 2 is a side elevational view of the reticle piece shown in FIG. 1.
Figure 3:
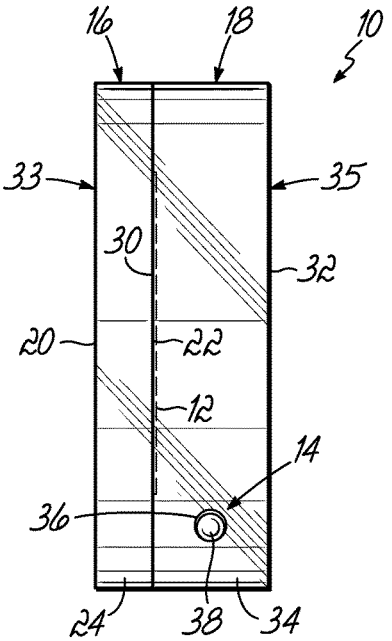
FIG. 3 is a front elevational view of the reticle piece shown in FIG. 1.

Referring first to FIGS. 1-3, a reticle piece is shown and is indicated at 10. The reticle piece 10 is generally cylinder-shaped and made of glass or other transparent material, and includes a reticle pattern 12. The reticle piece 10 includes an integral level indicating device 14. As will become apparent from the following description, the level indicating device 14 provides a shooter with a visual indication of whether the reticle piece 10, and the optical sight/firearm with which the reticle piece 10 is used, are properly leveled.

In the embodiment shown, the reticle piece 10 includes a body 15 having a first portion 16 and a second portion 18. As shown, the first portion 16 includes the reticle pattern 12 and the second portion 18 includes the level indicating device 14. Of course, it will be appreciated that a reticle piece could be constructed having a unitary body containing both a reticle pattern and a level indicating device.

The first portion 16 is generally disc-shaped and has opposed faces 20, 22, and a peripheral edge 24. The reticle pattern 12 is formed on the face 22, such as by etching or other well-known techniques. The reticle pattern 12 depicted is merely exemplary, and includes a vertical segment 26 and a horizontal segment 28. The reticle pattern 12 has a crosshair configuration, with the vertical and horizontal segments 26, 28 intersecting generally near the center of the reticle piece 10.

The second portion 18 is also generally disc-shaped and has opposed faces 30, 32, and a peripheral edge 34. The second portion 18 may be positioned adjacent the first portion 16 so the faces 30, 22 contact one another, as shown.

The first and second portions 16, 18 may have generally the same diameter such that the peripheral edges 24, 34 are aligned to provide a continuous outer edge of the reticle piece 10. Also, with the first and second portions 16, 18 positioned adjacent one another as shown, the face 20 provides a front face 33 of the body 15, and the face 32 provides a back face 35 of the body 15 opposed from the front face 33.

The level indicating device 14 may be formed integral with and internal to the reticle piece 10. As shown, the level indicating device 14 is generally between the front face 33 and the back face 35 of the body 15. In the embodiment shown, the body 15 includes an internal void 36 formed in the second portion 18. The void 36 extends transverse to a lengthwise axis of the cylinder-shaped body 15.

As shown, the void 36 may be positioned near a lower region of the second portion 18, so that the level indicating device 14 does not interfere with the reticle pattern 12 (as shown in FIG. 3). The level indicating device 14 includes a moveable leveling indicator 38 positioned in the void 36. The leveling indicator 38 can be a solid object, such as a ball, or may be a bubble in a liquid medium.

In the embodiment shown, the leveling indicator 38 is a small ball that is free to roll within the void 36. The ball may be approximately 1 mm in diameter and the void 36 approximately 1.04 mm in diameter. When the reticle piece 10 is level, the leveling indicator 38 will be positioned in the center of the void 36 (as shown in FIG. 3). Indicia 40 may be included for marking the position of the leveling indicator 38 when the device is level. If the reticle piece 10 is not level, the leveling indicator 38 will move away from the center of the void 36 and away from the indicia 40, providing a shooter with an indication that the reticle piece 10 (and therefore the optical sight) is not level. The indicia 40 may be considered part of the level indicating device 14. If desired, additional indicia (not shown) indicating gradation units of tilt, such as in degrees, may be included as well.

In other embodiments, the level indicating device 14 could be in the form of a bubble level, in which case the moveable leveling indicator 38 would be a bubble that is moveable but trapped within a liquid in the void 36.

The void 36 may be formed in any appropriate manner. For example, it may be formed by drilling or other means of cutting the glass or other material of the body 15 part way or all the way therethrough. Alternatively, a groove or channel may be formed in the face 30 of the second portion 18 and then closed by the face 22 of the first portion 16 to form a chamber when the two reticle portions 16, 18 are brought together. Alternatively, a groove or channel formed in the face 30 of the second portion 18 may be closed by applying a separate closure part or layer to the second portion 18. The void 36 may be closed and sealed after the leveling indicator 38, whether a ball or liquid and bubble, is inserted therein. This closure may be of one or both exposed ends of a partial or through-drilled void and may be in the form of a solid plug or curable material.

The void 36 may be formed in any desired and functionally appropriate shape. For example, and as shown, the void 36 can have a generally straight-line shape, extending across the second section 18 generally parallel with the horizontal segment 28 of the reticle pattern 12 (as shown in FIG. 2). In other embodiments, the void 36 can have an upwardly or downwardly curved or arcuate shape (not shown), such as to provide a centrally-located point where the leveling indicator 38 (whether a ball or a bubble) will rest when the device is level and from which the leveling indicator 38 will move if the reticle piece 10 is tilted to move the leveling indicator 38 away from the indicia 40. Thus, the shape of the void 36 can be chosen to assist in providing an indication of whether the reticle piece 10 is level and to avoid having the leveling indicator 38 be stuck and lag when the position is moved only slightly.

Moreover, the void 36 may have any appropriate profile. As shown in FIGS. 1 and 3, the void 36 has a generally round profile, but other shapes are also possible.

Referring next to FIGS. 4-7, a reticle piece according to another embodiment of the invention is shown and is indicated at 50. The reticle piece 50 is generally cylinder-shaped and made of glass or other transparent material, and includes a reticle pattern 52 and a level indicating device 54.

Figure 7:
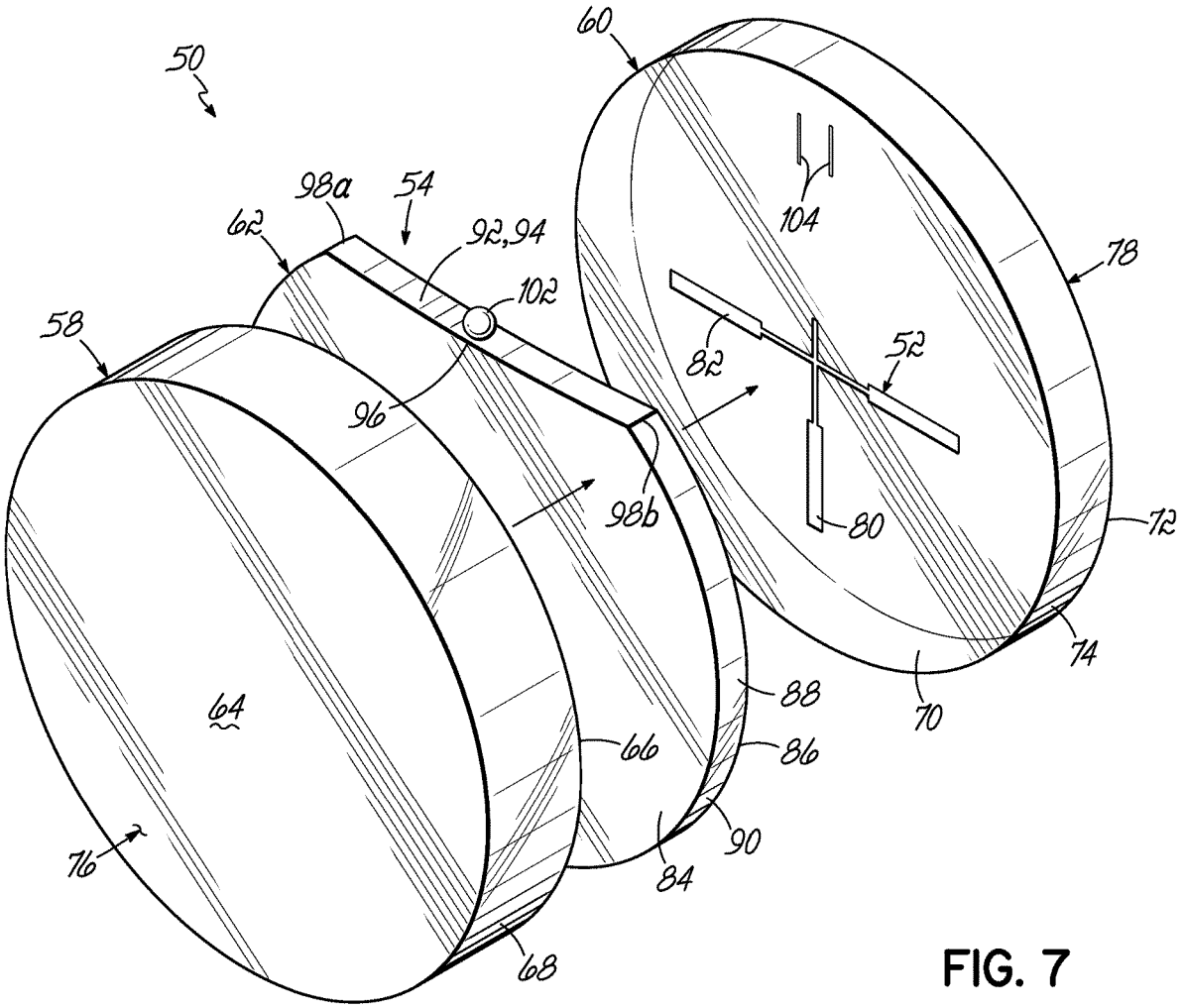
FIG. 7 is an exploded isometric view of the reticle piece shown in FIG. 4.

The reticle piece 50 has a body 56 that includes a first portion 58, a second portion 60, and a spacer plate 62 positioned between the first and second portions 58, 60. As shown in FIG. 7, the first portion 58, second portion 60, and spacer plate 62 are separate components that are combined to form the body 56, but it will also be appreciated that the reticle piece 50 could be constructed having a unitary body.

The first portion 58 is generally disc-shaped and has opposed faces 64, 66, and a peripheral edge 68. The second portion 60 is also generally disc-shaped and has opposed faces 70, 72, and a peripheral edge 74. The opposed faces 64, 72 provide a front face 76 and a back face 78, respectively, of the body 56. The peripheral edges 68, 74 have generally the same shape.

As shown in FIG. 7, the reticle pattern 52 is formed on the face 70 of the second portion 60, by etching or other well-known techniques. The reticle pattern 52 depicted is merely exemplary, and includes a vertical segment 80 and a horizontal segment 82. In the embodiment shown, the reticle pattern 52 has a duplex crosshair configuration, with the vertical and horizontal segments 80, 82 thinning out near their point of intersection.

Figure 5:
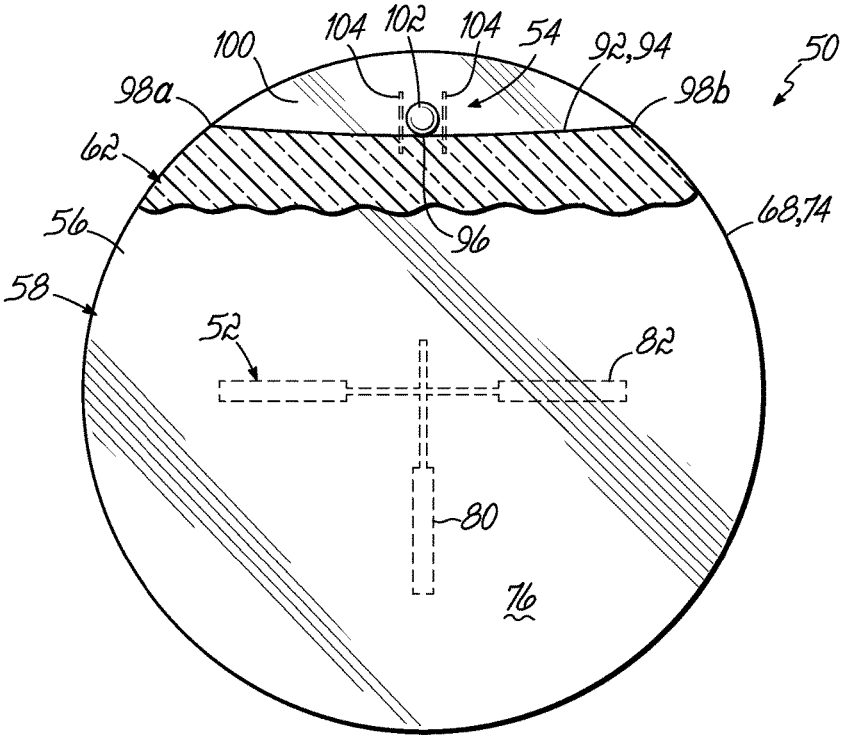
FIG. 5 is a front elevational view of the reticle piece shown in FIG. 4.

The spacer plate 62 is partially disc-shaped, and includes opposed faces 84, 86, and a peripheral edge 88. The peripheral edge 88 has a generally round first portion 90 that is similar in shape to parts of the peripheral edges 68, 74 of the first and second portions 58, 60. The spacer plate 62 includes an upper surface 92 that defines a slightly curved second portion 94 of the peripheral edge 88. As shown in FIG. 5, the upper surface 92 has a slight curve, with a low point 96 generally near a center region of the upper surface 92, and high points 98*a*, 98*b* generally near the intersection of the upper surface 92 with the first portion 90 of the peripheral edge 88. The upper surface 92 has a generally flat profile, as shown in FIG. 6.

Figure 4:
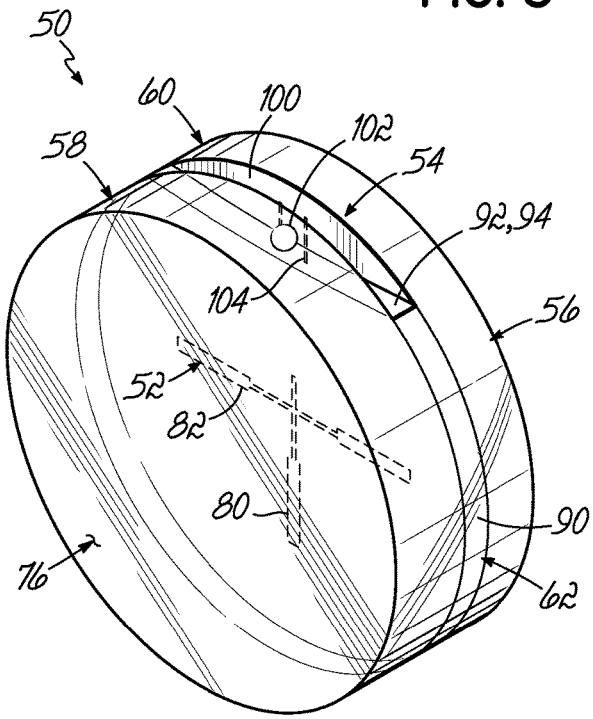
FIG. 4 is an isometric view of a reticle piece constructed according to another embodiment of the invention and including a level indicating device having a rolling ball.
Figure 6:
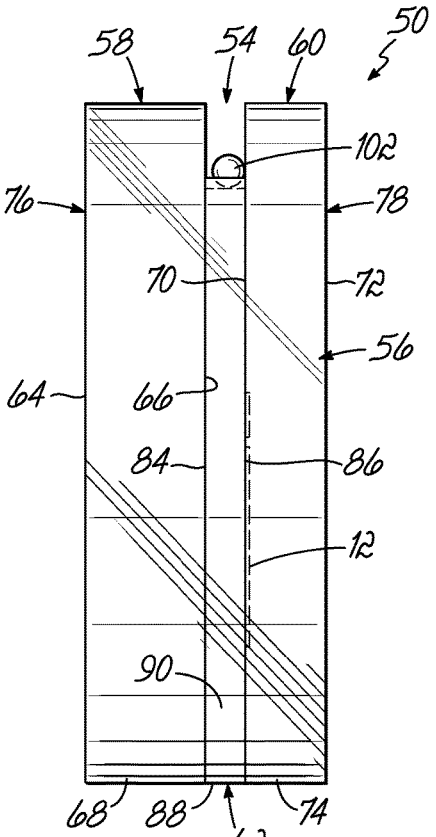
FIG. 6 is a side elevational view of the reticle piece shown in FIG. 4.

In the assembled configuration shown in FIGS. 4-6, the body 56 has an internal void 100 formed between the first and second portions 58, 60. In particular, the void 100 is defined in the space between the first and second portion 58, 60 above the upper surface 92 of the spacer plate 62. The void 100 extends transverse to a lengthwise axis of the generally cylinder-shaped body 56.

The level indicating device 54 may be formed integral with and internal to the reticle piece 50. As shown, the level indicating device 54 is generally between the front face 76 and the back face 78 of the body 56. The level indicating device 54 includes a moveable leveling indicator 102 positioned in the void 100. In particular, the leveling indicator 102 may be a ball that is configured to roll along the upper surface 92. The ball 102 may be constructed of any suitable material, and in some embodiments is constructed of glass, allowing it to be illuminated with the reticle, if desired. As shown, the void 100 may be positioned near an upper region of the body 56, so that the level indicating device 54 does not interfere with the reticle pattern 52 (as shown in FIG. 5).

As shown in FIG. 6, the spacer plate 62 has a thickness in the lengthwise dimension of the generally cylinder-shaped body 56 that allows the ball 102 to freely move within the void 100. When the reticle piece 50 is level, the ball 102 will be positioned in the center of the upper surface 92 (as shown in FIG. 5). Indicia 104 may be included for marking the position of the ball 102 when the device is level (as well as degrees of cant or tilt if desired). As shown, the indicia 104 is formed on or applied to the face 70 of the second portion 60. If the reticle piece 50 is not level, the ball 102 will move away from the center of the upper surface 92 and away from the indicia 104, providing a shooter with an indication that the reticle piece 50 (and, therefore, the optical sight) is not level. The indicia 104 may be considered part of the level indicating device 54 and may be formed in the same way the reticle is formed, allowing it to be illuminated, if desired.

Turning next to FIGS. 8A-10C, various spacer plates are shown that can be used in conjunction with a reticle piece, such as the reticle piece 50.

Figure 8A:
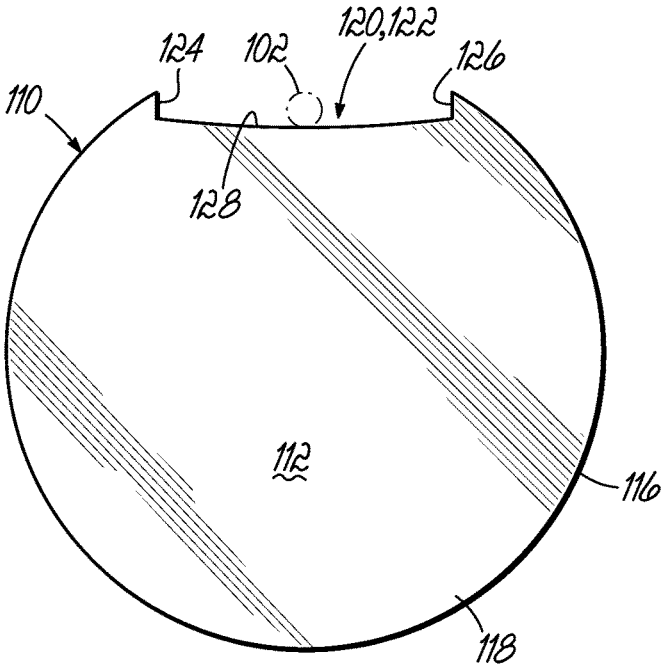
FIG. 8A is an isometric view of a spacer plate for a reticle piece according to another embodiment of the invention.
Figure 8B:
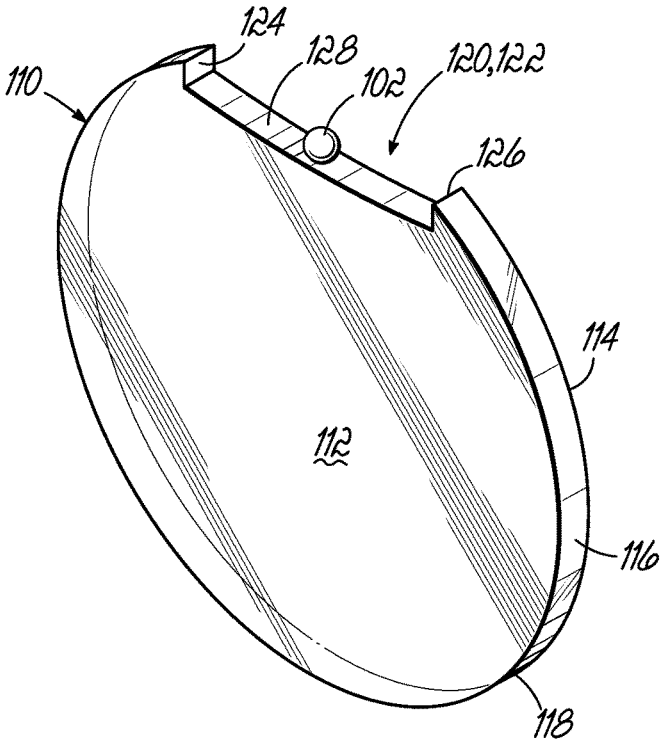
FIG. 8B is a front elevational view of the spacer plate shown in FIG. 8A.

FIGS. 8A and 8B show a spacer plate 110 that is partially disc-shaped, and includes opposed faces 112, 114, and a peripheral edge 116. The peripheral edge 116 has a generally round first portion 118 that is similar in shape to parts of the peripheral edges 68, 74 of the first and second portions 58, 60, as those portions are shown in FIGS. 4-7.

The spacer plate 110 includes a well 120 that defines a second portion 122 of the peripheral edge 116. The well 120 includes sidewalls 124, 126 and a bottom wall 128 extending between the sidewalls 124, 126. The sidewalls 124, 126 generally intersect with the bottom wall 128 at an angle, which in the embodiment shown is approximately 90°. The bottom wall 128 may have a slight curve, similar to the upper surface 92 described above. As shown, the bottom wall 128 has a generally flat profile.

Movement of a leveling indicator, such as a ball, with the spacer plate 110 would be confined within the well 120. In particular, the leveling indicator could move along the bottom wall 128, and the sidewalls 124, 126 would provide stops to limit the side-to-side travel of the leveling indicator. These physical stops do not necessarily have to be an integral part of the glass spacer plate, but other mechanical means may be employed to achieve the same intended purpose, such as a rubber plug or other material affixed between the plates at the ends of the curved radii of the bottom wall 128. This would achieve the same purpose and may reduce manufacturing/fabrication costs.

Figure 9A:
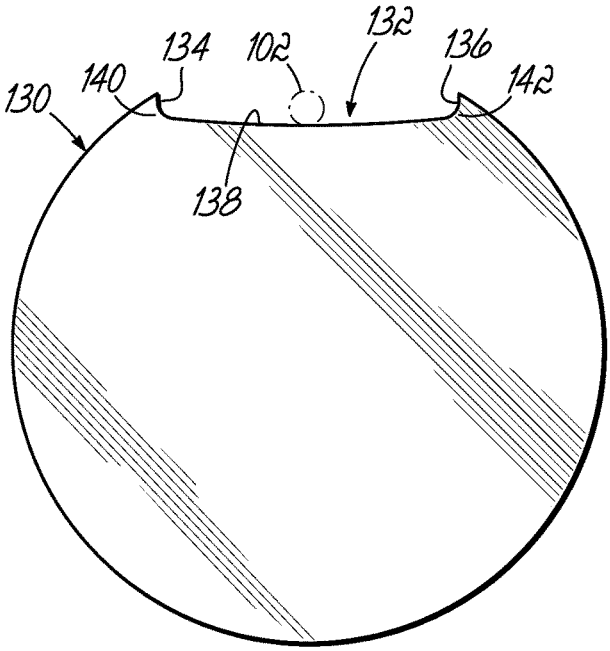
FIG. 9A is an isometric view of a spacer plate for a reticle piece according to another embodiment of the invention.
Figure 9B:
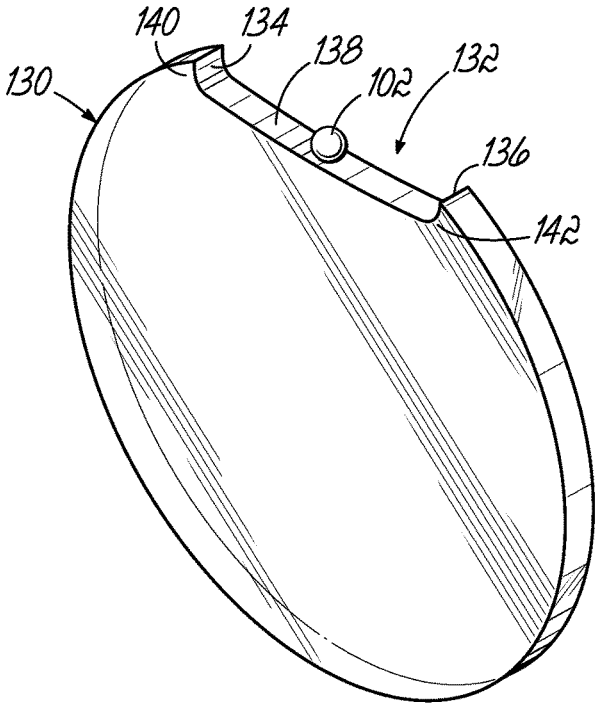
FIG. 9B is a front elevational view of the spacer plate shown in FIG. 9A.

FIGS. 9A and 9B show a spacer plate 130 that is substantially similar to the spacer plate 110, except that the spacer plate 130 includes a well 132 having sidewalls 134, 136 that intersect with a bottom wall 138 through curved radius sections 140, 142, respectively.

Movement of a leveling indicator, such as a ball, with the spacer plate 130 would be confined within the well 130. In particular, the leveling indicator could move along the bottom wall 138, and the sidewalls 134, 136 would provide stops to limit the side-to-side travel of the leveling indicator. The curved radius sections 140, 142 would provide control over stopping the leveling indicator as it reaches the sidewalls 134, 136.

Figure 10A:
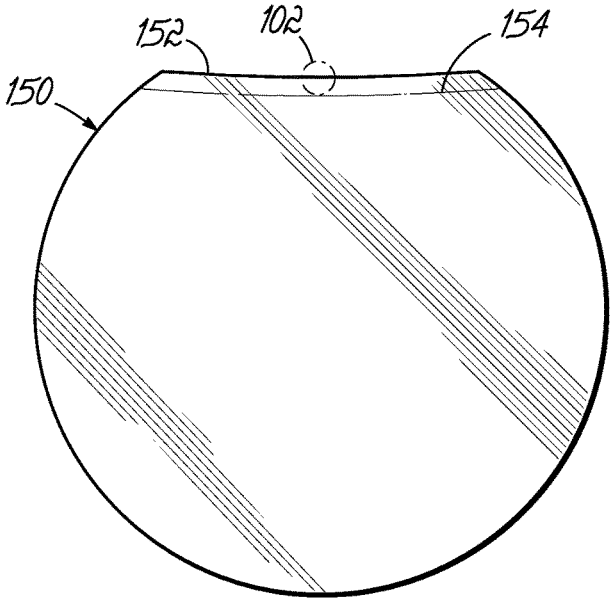
FIG. 10A is an isometric view of a spacer plate for a reticle piece according to another embodiment of the invention.
Figure 10B:
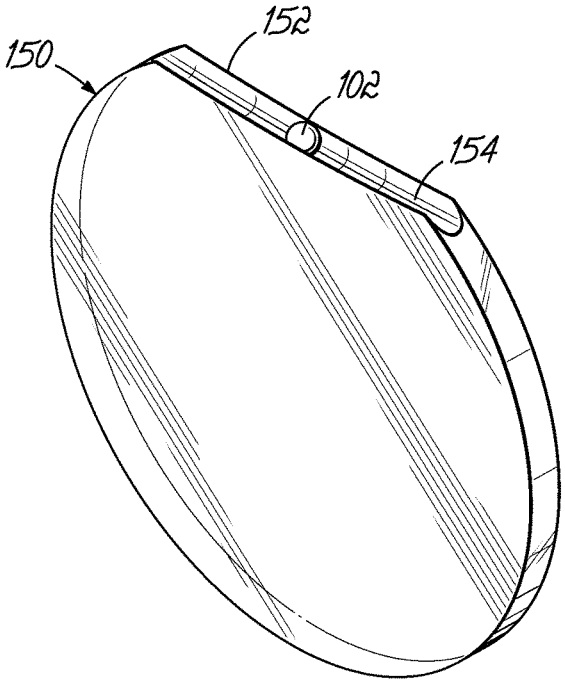
FIG. 10B is a front elevational view of the spacer plate shown in FIG. 10A.
Figure 10C:
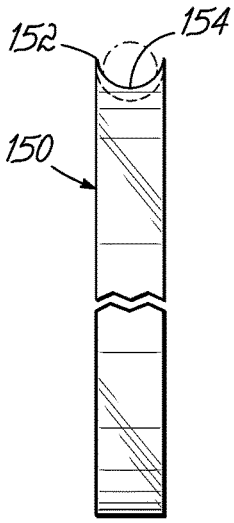
FIG. 10C is a side elevational view of the spacer plate shown in FIG. 10A.
Figure 12:
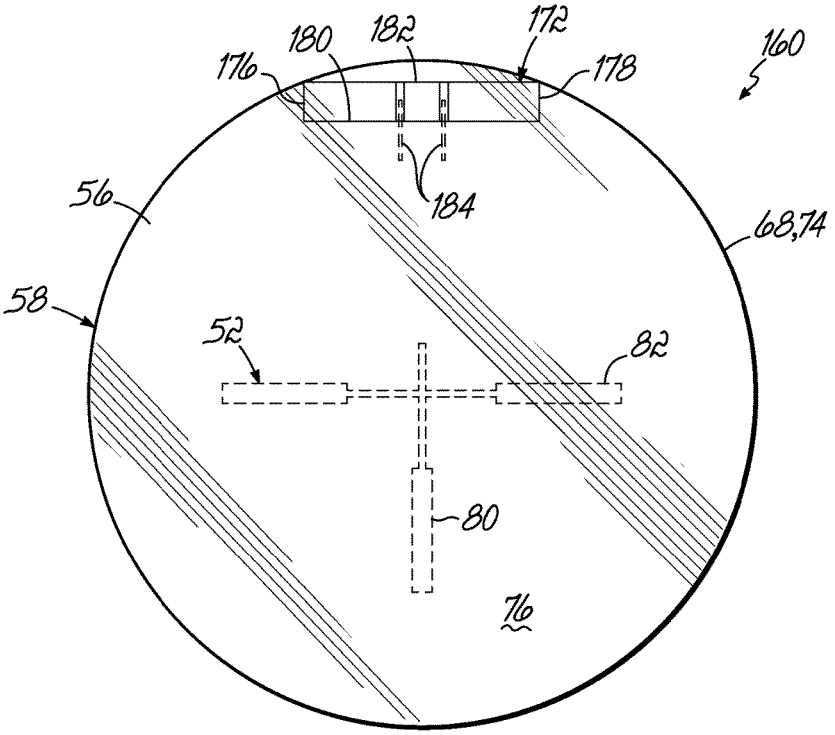
FIG. 12 is a front elevational view of the reticle piece shown in FIG. 11.
Figure 11:
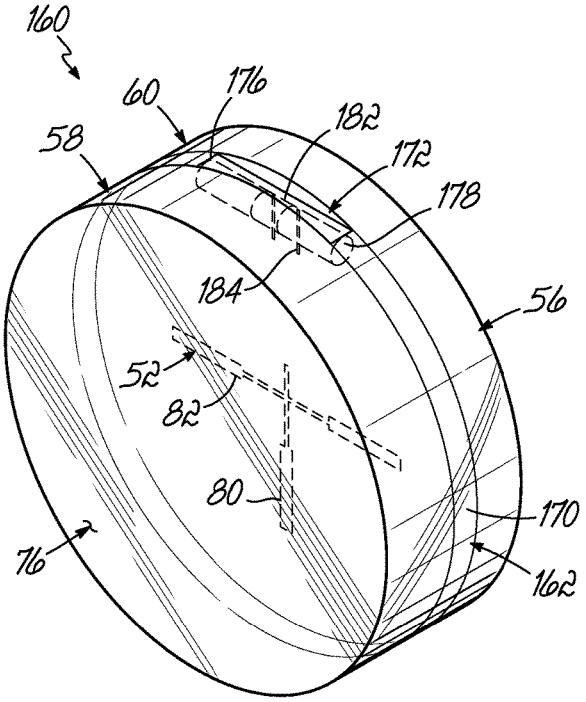
FIG. 11 is an isometric view of a reticle piece constructed according to another embodiment of the invention and including a level indicating device having a moveable bubble.
Figure 13:
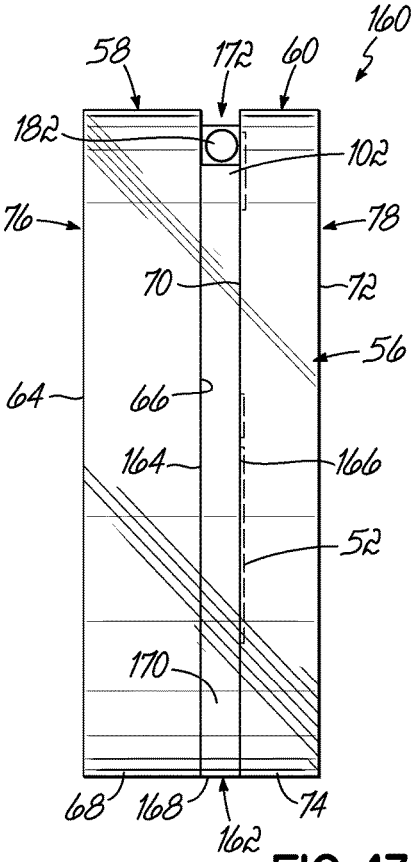
FIG. 13 is a side elevational view of the reticle piece shown in FIG. 11.
Figure 14:
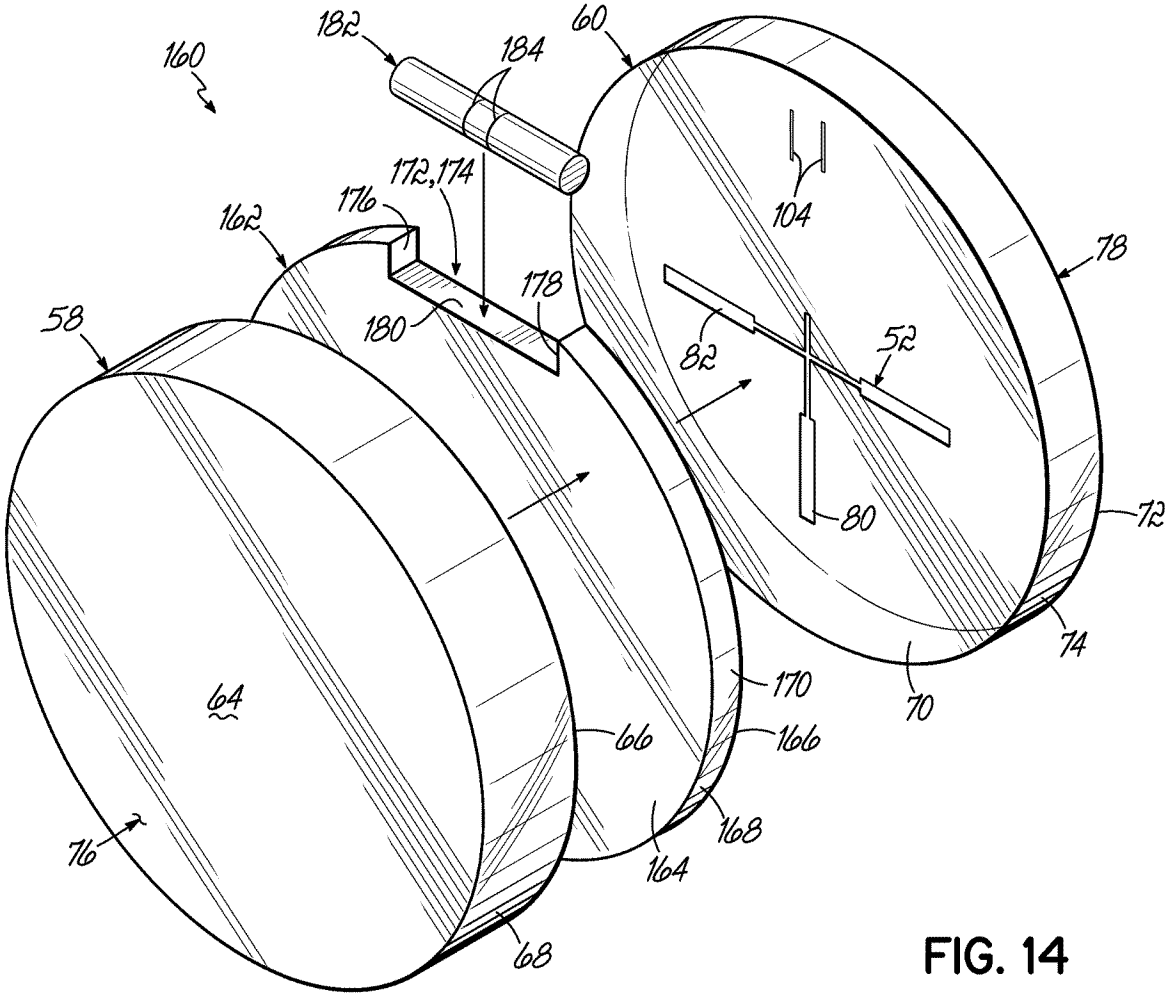
FIG. 14 is an exploded isometric view of the reticle piece shown in FIG. 11.

FIGS. 10A-10C show a spacer plate 150 that is substantially similar to the spacer plate 62, except that the spacer plate 150 includes an upper surface 152 having a generally curved channeled profile, as shown in FIG. 10C. In particular, the curve of the profile opens generally upwardly and provides a grooved channel or track 154 in which a leveling indicator, such as a ball, could move. As shown, the track 154 has a generally curved concave radius or channel formed in the upper surface 152 of the spacer plate 150.

Referring next to FIGS. 11-14, a reticle piece 160 is shown that is generally similar to the reticle piece 50, except for the spacer plate and the level indicating device. In FIGS. 11-14, a spacer plate 162 is used in conjunction with first and second portions 58, 60, as those features are described above and shown in FIGS. 4-7.

The spacer plate 162 is partially disc-shaped, and includes opposed faces 164, 166, and a peripheral edge 168. The peripheral edge 168 has a generally round first portion 170 that is similar in shape to parts of the peripheral edges 68, 74 of the first and second portions 58, 60.

The spacer plate 110 includes a well 172 that defines a second portion 174 of the peripheral edge 116. The well 172 includes sidewalls 176 or other mechanical means (not shown), 178 and a bottom wall 180 extending between the sidewalls 176, 178. The well 172 is configured to receive a level indicating device in the form of a bubble level vial 182 according to well-known construction. Advantageously, the well 172 may be configured to limit movement of the bubble level vial 182 when it is in the well 172.

The bubble level vial 182 is generally conventional and includes a gas bubble trapped in a liquid medium. When the reticle piece 160 is level, the bubble will be positioned in the center of the bubble level vial 182. Indicia 184 may be included for marking the position of the bubble when the device is level. As shown, the indicia 184 may be formed on the face 70 of the second portion 60, or on the bubble level vial 182. If the reticle piece 160 is not level, the bubble will move away from the center of the bubble level vial 182 and away from the indicia 184, providing a shooter with an indication that the reticle piece 160 (and therefore the optical sight) is not level. If desired, additional indicia (not shown) indicating gradation units of tilt, such as in degrees, may be included as well.

Figure 15:
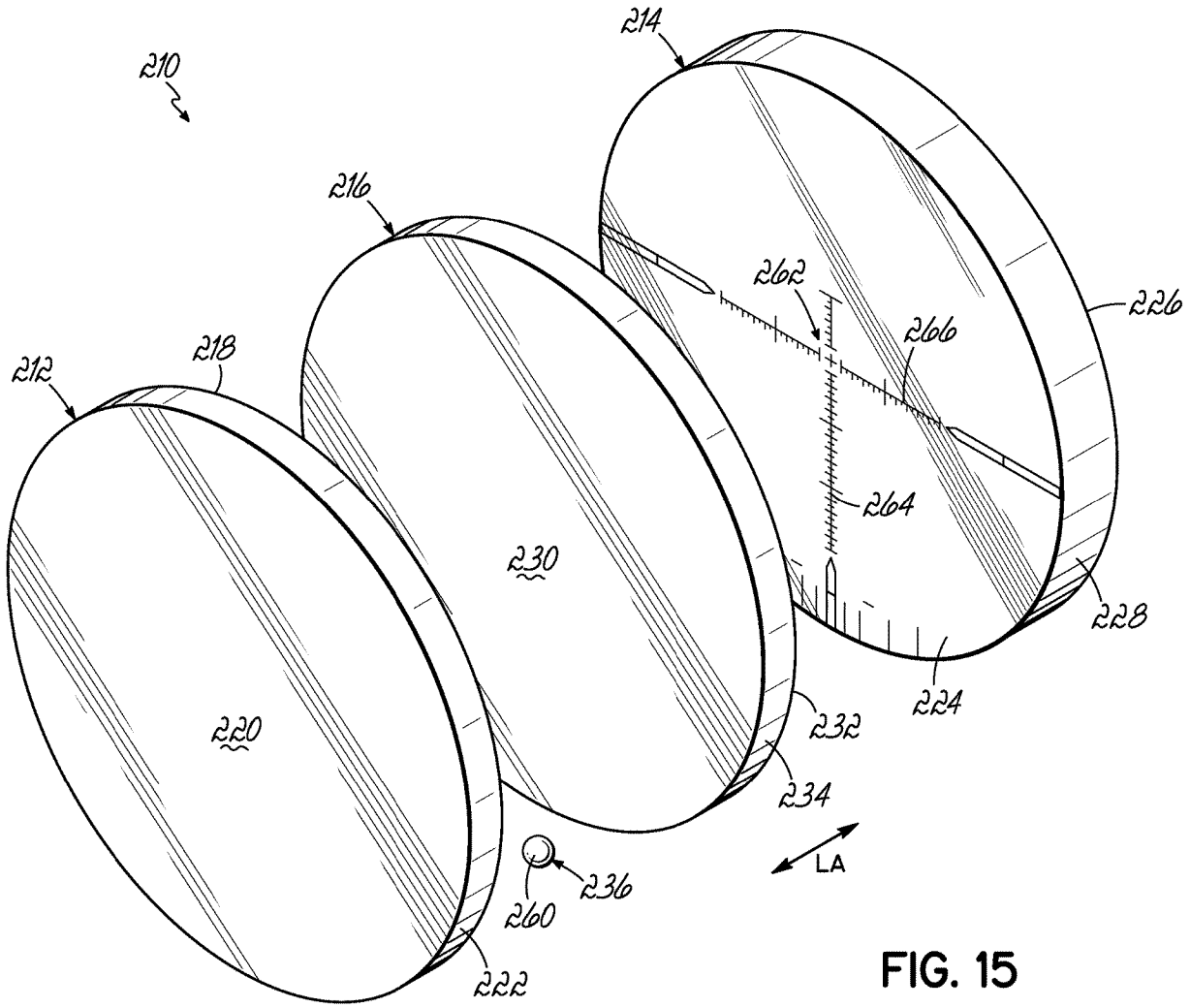
FIG. 15 is an exploded isometric view of the reticle piece according to yet another embodiment of the invention.
Figure 16:
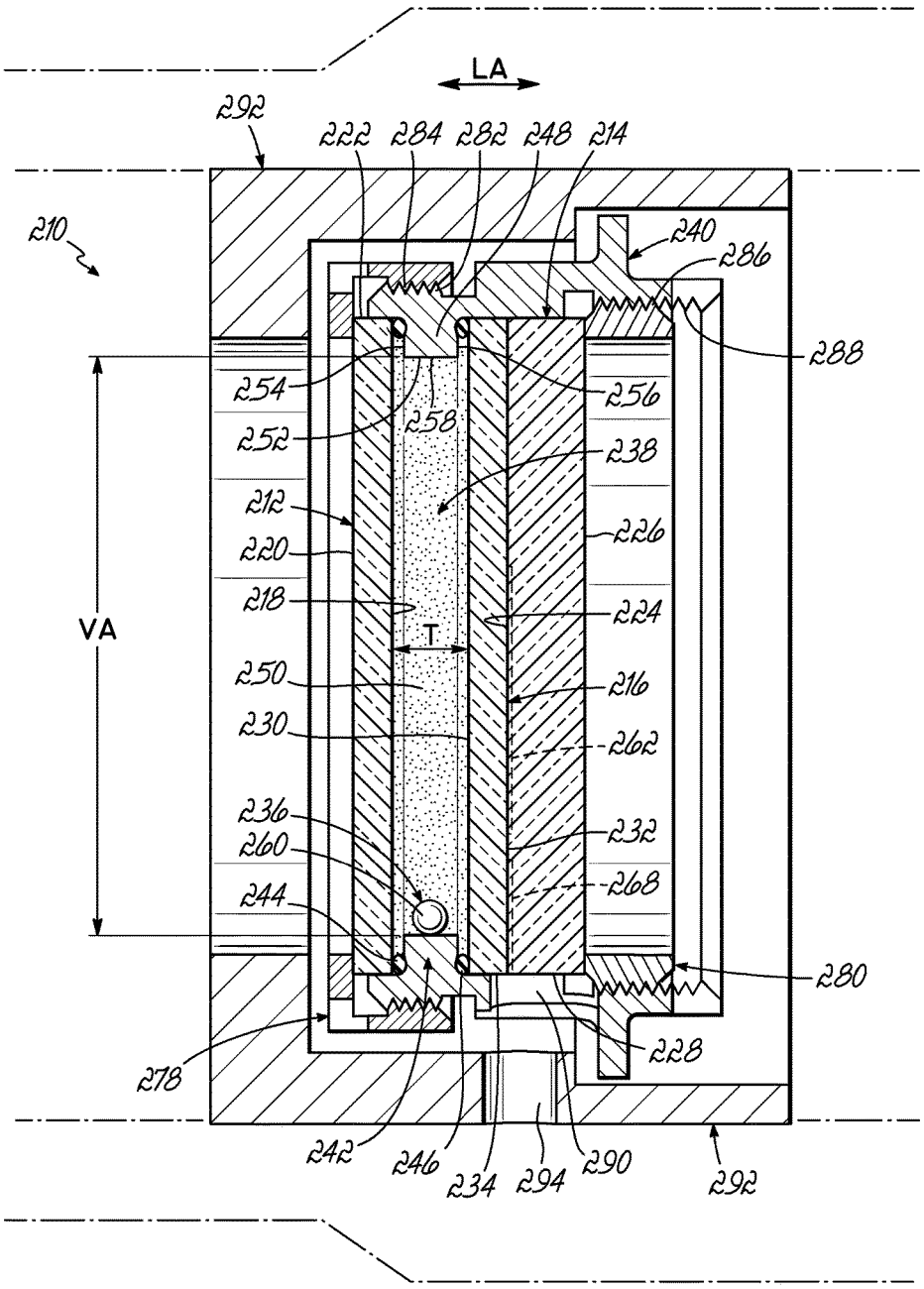
FIG. 16 is cross-sectional view of the cross-sectional of the reticle piece of FIG. 15 including a housing.
Figure 17:
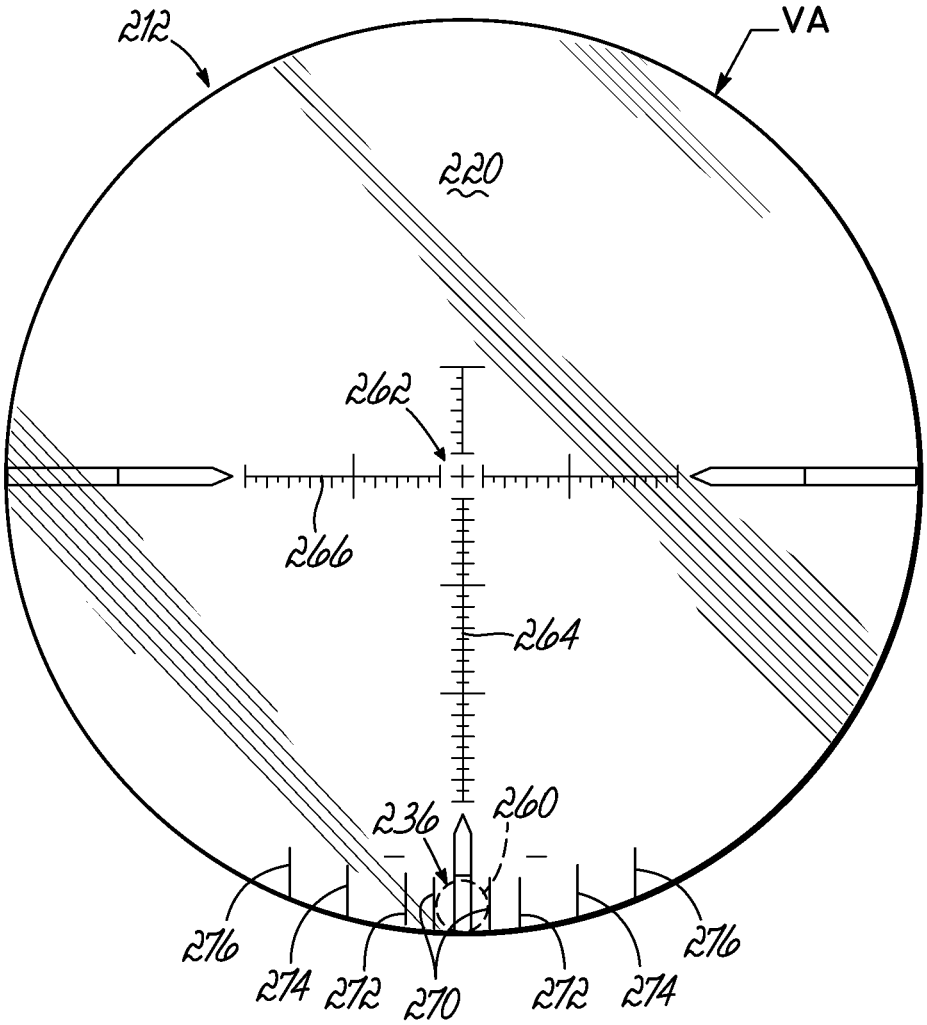
FIG. 17 is a front elevational view of the reticle piece shown in FIG. 15.

Referring now to FIGS. 15-17, a reticle piece 210 for use in an optical sight (not shown) is shown according to another embodiment of the present invention. The reticle piece 210 may also be used with telescopic sights, and may be placed in either the first focal plane or second focal plane of the telescopic sight (not shown), as appropriate or desired. Additionally, the reticle pattern 262 may be placed in the first focal plane while the moveable leveling indicator 236 is placed in the second focal plane or vice versa, indicating that the moveable leveling indicator 236 may be used independently of the reticle pattern 262, as well as including a reticle pattern 262.

As shown in FIG. 15, the reticle piece 210 includes a first portion 212, a second portion 214, and a third portion 216 which are each generally cylinder-shaped and made of glass or another transparent material. The first portion 212 has a first inner face 218 disposed opposite from a front face 220, and a first peripheral edge 222 extending therebetween in the lengthwise axis (LA) of the reticle piece 210. Similarly, the second portion 214 has a second inner face 224 and a back face 226 disposed opposite the front face 220 of the first portion 212. The second portion 214 also has a second peripheral edge 228 extending between the second inner face 224 and the back face 226 along the lengthwise axis (LA) of the reticle piece 210.

The third portion 216 is disposed between the first and second portions 212, 214. The third portion 216 includes third and fourth inner faces 230, 232, and a third peripheral edge 234 extending therebetween in the lengthwise axis (LA) of the reticle piece 210. As shown, the fourth inner face 232 of the third portion 216 is positioned adjacent the second inner face 224 of the second portion 214. In the exemplary embodiment shown, the first portion 212 is about one millimeter thick, the second portion 214 is about two millimeters thick, and the third portion 216 is about one millimeter thick. However, one skilled in the art would appreciate that these thicknesses may vary. The reticle piece 210 also includes a moveable leveling indicator 236 disposed within a cavity 238 (shown in FIG. 16).

Referring now to the cross-sectional view of FIG. 16, the first, second, and third portions 212, 214, 216 are at least partially enclosed by a housing 240. The housing 240 includes a spacing element 242 that partially forms the cavity 238. The spacing element 242 is disposed between the first and third portions 212, 216 (if first, second, and third portions 212, 214, 216 are used) or between the first and second portions 212, 214 (if only first and second portions 212, 214 are used). The spacing element 242 may include front and back sealing elements 244, 246 and a projection 248 therebetween. As shown, the front and back sealing elements 244, 246 are O-rings made from any suitable material. For example, according to one exemplary embodiment, the O-rings are made from a perfluoroelastomer (FFKM) material capable of withstanding a wide range of temperatures and resistant to a variety of chemicals, which prevents degradation of the O-ring caused by the interaction with the fluid 250.

The projection 248 includes an interior face 252, a front face 254, and a back face 256. The interior face 252 of the projection 248 and the front and back sealing elements 244, 246 form the perimeter 258 of the cavity 238. The perimeter 258 defines a viewable area (VA) of the reticle piece 210. When the front and back sealing elements 244, 246 are omitted, the interior face 252 defines the perimeter 258. The cavity 238 extends transverse to a lengthwise axis (LA) of the first and second portions 212, 214. In the embodiment shown, the thickness (T) of the cavity 238 is approximately two millimeters, which is filled with approximately 0.35 milliliters of fluid 250. However, one skilled in the art would appreciate that this thickness (T) may vary.

A moveable leveling indicator 236 is disposed within the cavity 238 and capable of moving along at least a portion of the perimeter 258 of the cavity 238. As shown, the moveable leveling indicator 236 is capable of moving along the entire viewable area (VA) including entire perimeter 258 of the cavity 238. As shown in the cross-section of FIG. 16, the moveable leveling indicator 236 includes a microsphere 260 trapped in fluid 250. Alternatively, while not shown, the moveable leveling indicator 236 may include a bubble trapped in fluid 250. The moveable leveling indicator 236 is designed to indicate a level sensitivity within 1%.

It is desirable that the material of the microsphere 260 be compatible with the fluid 250. In addition, it is desirable to "match" the density of the fluid 250 to the density of the microsphere 260 to provide near neutral buoyancy which reduces friction at the riding surface and reduces the effect of any surface imperfections at this interface. One skilled in the art would appreciate that a microsphere 260 with a material density less than that of the density of the fluid 250 would result in the microsphere 260 floating at or being located near the top of the cavity 238 in the fluid 250. Conversely, a microsphere 260 with a material density greater than that of the fluid density 250 would result in the microsphere 260 sinking to or be located near the bottom of the cavity 238 in the fluid 250 as shown in FIG. 17.

In one exemplary embodiment, the microsphere 260 is approximately 800 microns in diameter and is made from Polyethylene having a density of about 1.0 gram per cubic centimeter. Alternatively, if the microsphere 260 is used in the first focal plane, the microsphere 260 would be sized accordingly to accommodate the effective focal length of the system or magnification. In other words, the microsphere would be smaller (such as a nanosphere). Surface tension and viscosity (as a result of viscous drag) are also among the various factors in providing the ideal motion sensitivity of the microsphere 260. When assembled, hydrogen molecule bonding acts as an attractive force between the fluid 250 and the first and third portions 212, 216 causing negative atmospheric pressure within the cavity 238. This compression aids in sealing the cavity 238.

Any suitable single liquid or suitable combination of liquids may be used as the fluid 250. However, the fluid 250 selection is based at least in part upon the selected material of the microsphere 260. It is preferable that the densities of the microsphere 260 and the fluid 250 are within about 10% of each other. For example, in one exemplary embodiment where the microsphere 260 is made from Polyethylene, the fluid 250 may comprise Ethyl Alcohol (Ethanol), a solute of surfactant to control surface tension (e.g., TWEEN® 80 commercially available from Sigma-Aldrich of St. Louis, Mo.), and Propylene Carbonate to adjust the density of the fluid 250 to just below 1.0 gram per cubic centimeter. The solute of surfactant and the Propylene Carbonate increase the upper temperature range of the Ethanol from about 173 degrees Fahrenheit to over 200 degrees Fahrenheit. It is desirable that the operating temperature of the fluid 250 vary widely so as to accommodate a variety of intended uses in the outdoors. In another exemplary embodiment, the fluid 250 may comprise Ethyl Acetate and a solute of surfactant (e.g. TWEEN® 80). Alternatively, the fluid 250 may be entirely Ethyl Acetate (100% Ethyl Acetate), entirely Propylene Carbonate (100% Propylene Carbonate) and/or other liquids and microsphere materials as one skilled in the art would appreciate.

Having the cavity 238 extend along the entire viewable area (VA) of the reticle piece 210 provides many benefits over known reticles. For example, having an increased volume of the fluid 250 diminishes the negative compression factors seen when having a small volume of fluid 250. Additionally, the increased volume of fluid 250 aids in sealing, preventing the fluid 250 from escaping the cavity 238. Also, the moveable leveling indicator 236 is capable of freely moving about the entire cavity 238 unlike known reticle pieces. This design also significantly reduces the costs associated with manufacturing the components, since the first, second, and/or third portions 212, 214, 216 are not machined with a radius or an aperture. Furthermore, the small size of the moveable leveling indicator 236 does not adversely affect the viewable area (VA). As will be explained further below, this also allows the degrees of cant to encompass all 360 degrees of the cavity 238.

Having the cavity 238 and corresponding fluid 250 extend across viewable area (VA) does not adversely affect the optical performance, resolution or magnification of the reticle piece 210. This is because the refractive index of the fluid 250 is very close to the refractive index of the first, second, and third portions 212, 214, 216. As a result, the minor difference in the refractive index only slightly alters that the eyepiece Diopter range, by reducing the plus side and increasing the minus side approximately 0.5 Diopters, since a one millimeter space produces a change of only 0.25 Diopters. Since a majority of the population has a minus Diopter, this may actually benefit these individuals by increasing the minus Diopter range. Additionally, since the eyepiece Diopter accommodation may be simply a mechanical thread length, any changes may be sufficiently factored into the design.

As shown in FIGS. 15-17, a reticle pattern 262 is formed on the second inner face 224 of the second portion 214. Like the previous embodiments, the reticle pattern 262 has a vertical segment 264 and a horizontal segment 266. Indicia 268 may be included for marking the position of the moveable leveling indicator 236 when the reticle piece 210 is horizontally level, and includes gradation units of tilt. As shown, the indicia 268 may be formed on the second inner face 224 of the second portion 214 and/or the fourth inner face 232 of the third portion 216. The moveable leveling indicator 236 is configured to move to one side of the zero degree 270 markings to provide the shooter with an indication that the reticle piece 210 (and therefore the optical sight) is not level. As shown in FIG. 17, various gradation units of tilt are indicated, zero degrees 270, five degrees 272, ten degrees 274, and fifteen degrees 276, however, one skilled in the art would appreciate that more or less gradation units of tilt may be included, if desired. As discussed above, while not shown in FIG. 17, the microsphere 260 may also float at the top of the cavity 238 by adjusting material and/or fluid densities. Specifically, the microsphere 260 may float to the top, if the density of the microsphere 260 is less than the density of the fluid 250.

The embodiment shown in FIGS. 15-17 utilizes has a second focal plane design, where the third portion 216 provides illumination to the reticle pattern 262 and also protects the reticle pattern 262 from any possible chemical erosion caused the reticle pattern 262 interacting with the fluid 250. While not shown, a first focal plane design may omit the third portion 216. However, the moveable leveling indicator 236 could still be used in a second focal plane design, with the indicia 268 and/or the reticle pattern 262 in both planes being not necessary.

As shown in FIG. 16, front and back locking elements 278, 280 keep the reticle piece 210 in place. The front locking element 278 threadably couples the first portion 212 to the housing 240. Specifically, the external threads 282 of the housing 240 interact with internal threads 284 of the front locking element 278 to force the front face 220 of the first portion 212 against the front face 254 of the projection 248. Similarly, the back locking element 280 threadably couples the second portion 214 to the housing 240. Specifically, the external threads 286 of the back locking element 280 interact with internal threads 288 of the housing 240 to force the back face 226 of the second portion 214 against the third portion 216. While not shown, there may also be redundant O-rings positioned adjacent the front face 220 and the back face 226.

The housing 240 may also include an illumination port 290 configured to receive light from a light source (not shown), such as, for example, one or more light emitting diodes not shown allowing for the reticle pattern 262 to be illuminated. The housing 240 may be separate from the scope housing 292, or alternatively the housing 240 may be formed integrally as a unitary piece with the scope housing 292. The scope housing 292 may include a second illumination port 294.

A method of manufacturing a reticle piece 210 for use in an optical sight is also described. For improved sealing, a back sealing element 246 may be inserted adjacent the back face 256 of the projection 248 prior to inserting the third portion 216 into the housing 240. The third portion 216 is then inserted into the housing 240 adjacent the rear side of the projection 248 (or the back sealing element 246). The second portion 214 is then inserted into the housing 240 adjacent the third portion 216. The back locking element 280 may then be coupled to the housing 240 to secure the second and third portions 214, 216. The reticle piece 210 may then be flipped over.

A front sealing element 244 may be inserted adjacent the projection 248 prior to inserting the moveable leveling indicator 236. The moveable leveling indicator 236 is then inserted into the cavity 238 formed by the third portion 216 (if three portions are used as discussed above) and the spacing element 242. The moveable leveling indicator 236 may be inserted using a syringe, or by other methods. The cavity 238 is then filled with a fluid 250 using a syringe. The cavity 238 may be overfilled, so that the fluid 250 forms a meniscus to prevent air from being introduced into the cavity 238 when the second portion 214 is subsequently inserted. The first portion 212 is then inserted adjacent the front face 254 of the projection 248 to enclose the cavity 238. Specifically, the first portion 212 is skimmed in from the side (held by a suction cup) preventing the introduction of air into the assembly. The front locking element 278 is then coupled to the housing 240 to secure the first portion 212. The reticle piece 210 may be then thoroughly cleaned.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A reticle piece for use in an optical sight, comprising:

a first portion having a front face;

a second portion having a back face disposed opposite the front face;

a housing including a spacing element that forms a cavity extending between the first and second portions, the cavity having a perimeter that defines a viewable area of the reticle piece;

a reticle pattern on the second portion; and a moveable leveling indicator within the cavity and capable of moving along at least a portion of the perimeter of the cavity.

2. The reticle piece of claim 1, further comprising a third portion disposed between the first and second portions, such that the cavity is formed between the first and third portions and the reticle pattern is on one of the second or third portions.

3. The reticle piece of claim 1, wherein the spacing element includes front and back sealing elements and a projection therebetween.

4. The reticle piece of claim 1, further comprising front and back locking elements, wherein the front locking element couples the first portion to the housing and the back locking element couples the second portion to the housing.

5. The reticle piece of claim 1, wherein the second portion further comprises a second inner face disposed opposite the back face, such that the reticle pattern is on the second inner face.

6. The reticle piece of claim 1, wherein the moveable leveling indicator is capable of moving along the entire perimeter of the cavity.

7. The reticle piece of claim 1, wherein the moveable leveling indicator further comprises a bubble trapped in a fluid.

8. The reticle piece of claim 1, wherein the moveable leveling indicator further comprises a microsphere trapped in a fluid.

9. The reticle piece of claim 8, wherein the densities of the microsphere and the fluid are within 10% of each other, either causing the microsphere to float or sink in the fluid.

10. The reticle piece of claim 8, wherein the fluid comprises about 70-90% of Ethyl Alcohol, about 0-10% of a solute of a surfactant, and about 9-29% of Propylene Carbonate.

11. The reticle piece of claim 8, wherein the fluid comprises about 80% of Ethyl Alcohol, about 1% of a solute of a surfactant, and about 19% of Propylene Carbonate.

12. The reticle piece of claim 8, wherein the fluid comprises more than 90% of Ethyl Acetate and less than 10% of a solute of a surfactant, and preferably about 99% of Ethyl Acetate and about 1% of a solute of a surfactant.

13. The reticle piece of claim 8, wherein the fluid consists of 100% Ethyl Acetate.

14. The reticle piece of claim 8, wherein the fluid consists of 100% Propylene Carbonate.

15. The reticle piece of claim 1, wherein the reticle piece further includes indicia marking a position of the moveable leveling indicator when the reticle piece is level.

16. The reticle piece of claim 15, wherein the indicia is formed on the reticle piece and further includes gradation units of tilt.

17. The reticle piece of claim 1, wherein the housing further comprises an illumination port configured to receive light from a light source allowing for the reticle pattern to be illuminated.

18. A method of manufacturing a reticle piece for use in an optical sight, the reticle piece including first, second and third portions, a moveable leveling indicator, front and back locking elements, and a housing including a projection having first and second sides, the method comprising:

inserting the third portion into the housing adjacent the rear side of the projection;

inserting the second portion into the housing adjacent the third portion;

coupling the back locking element to the housing to secure the second and third portions;

inserting a moveable leveling indicator into a cavity formed by the third portion and a spacing element;

filling the cavity with a fluid;

inserting the second portion adjacent the front side of the projection to enclose the cavity; and coupling the front locking element to the housing to secure the first portion.

19. The method of claim 18, wherein filling the cavity further comprises overflowing the cavity with the fluid to form a meniscus that prevents air from being introduced into the cavity when the second portion is subsequently inserted.

20. The method of claim 18, wherein the spacing element includes front and back sealing elements with the projection therebetween, the method further comprising:

inserting the back sealing element adjacent a back face of the projection prior to inserting the third portion into the housing; and inserting the front sealing element adjacent a front face of the projection prior to inserting the moveable leveling indicator.

* * * * *